US009102194B2

(12) United States Patent
Duckett

(10) Patent No.: US 9,102,194 B2
(45) Date of Patent: Aug. 11, 2015

(54) PAINT BUCKET WITH A BOTTOM HOLD

(71) Applicant: Daran Duckett, Phoenix, AZ (US)

(72) Inventor: Daran Duckett, Phoenix, AZ (US)

( * ) Notice: Subject to any disclaimer, the term of this patent is extended or adjusted under 35 U.S.C. 154(b) by 73 days.

(21) Appl. No.: 13/921,682

(22) Filed: Jun. 19, 2013

(65) Prior Publication Data

US 2014/0374425 A1 Dec. 25, 2014

(51) Int. Cl.

| | |
|---|---|
| ***B44D 3/14*** | (2006.01) |
| ***A47G 19/02*** | (2006.01) |
| ***A47G 23/06*** | (2006.01) |

(52) U.S. Cl.

CPC ..... *B44D 3/14* (2013.01); *A47G 19/065* (2013.01); *A47G 23/0625* (2013.01)

(58) Field of Classification Search

CPC . B65D 23/10; B65D 25/2882; B65D 25/2897
USPC ..... 220/605, 606, 756, 771, 914, 608, 770, 220/628, 635, 636, 647, 570; 215/396, 398
See application file for complete search history.

(56) References Cited

U.S. PATENT DOCUMENTS

| | | | | | |
|---|---|---|---|---|---|
| 2,142,811 | A * | 1/1939 | Agonis | ..... | 215/384 |
| 2,865,384 | A * | 12/1958 | Noon | ..... | 132/73 |
| 3,198,377 | A * | 8/1965 | Buckley | ..... | 220/771 |
| 4,967,918 | A * | 11/1990 | Long | ..... | 215/385 |
| 5,353,952 | A * | 10/1994 | Donche | ..... | 220/575 |
| 5,671,864 | A * | 9/1997 | Caruthers | ..... | 220/737 |
| 2005/0077325 | A1 * | 4/2005 | McDonald et al. | ..... | 222/566 |

* cited by examiner

*Primary Examiner* — Fenn Mathew
*Assistant Examiner* — Madison L Poos
(74) *Attorney, Agent, or Firm* — Invention To Patent Services; Alex Hobson

(57) ABSTRACT

A Paint bucket with a bottom hold feature comprising, a substantially conical shaped body with a wide top and narrower base with a circular foot section having an aperture configured in its middle center through which the fingers of an open hand with palms facing upward can be inserted to hold the bucket up vertically by its base with just one hand. The bucket does not require any handles, hooks, straps, or other appendages to hold the bucket in one hand and can be used to hold and transport other liquids and materials besides paint and comes with a detachable lid.

10 Claims, 5 Drawing Sheets

PAINT BUCKET WITH A BOTTOM HOLD

FIELD OF THE INVENTION

This invention is generally related to buckets and containers for holding and transporting liquid and solid materials. More particularly, the invention relates to a paint bucket capable of being held from the bottom with one hand without the use of a handle or other gripping appendages.

BACKGROUND OF THE INVENTION

The use of buckets with an open top and flat bottom to carry liquid and solid materials have been in vogue since the days of the Roman Empire. The majority of buckets have a semi-circular handle attached to their top end, generally referred to, as a bail, for carrying the bucket with one or both hands, depending on the weight of the material in the bucket.

Paint in general is sold in cylindrical containers with semi-circular handles to allow the painter to hold the container with one hand while the paint brush is held in the other hand for dipping into the paint in the bucket, to paint a wall or other surface. In order for the paint brush to have unencumbered access to the paint in a paint container or bucket with a handle, the handle and the hand holding the handle need to be positioned away from the paint surface, a feat that is difficult to accomplish because if the handle is not held upright and held to one side away from the paint surface, there is a tendency for the paint bucket to tilt to the other side resulting in the paint spilling over from the bucket. To avoid such mishaps, professional painters generally hold and carry the paint bucket or container by hooking the thumb around the bale/handle and sliding the fingers under the bottom of the bucket.

In an attempt to provide additional support for the thumb when holding down the paint bucket handle to the side of the container, prior art have come up with various devises. U.S. Pat. No. 6,851,571 to LaLonde describes the thumb held in a sleeve connected to a holder attached to the paint container handle, to allow the weight of the container to be transferred to the remainder of the hand supporting the bottom of the container. U.S. Pat. No. 5,471,681 to Ferrini, describes a hook on a glove to hold the container handle down. U.S. Pat. No. 5,251,781 and U.S. Pat. No. 5,092,481 to Skelton describe paint containers with their handles pulled down to one side and held in that position by the thumb inserted into a hook or in a loop configured by a hook and loop fastener. U.S. Pat. No. 5,570,807 to Busch describes another apparatus and method for holding a container with one hand where a fastener is attached to the open rim of the container to hold the thumb in a sleeve against the side of the container while the remaining fingers support the bottom of the container.

The devices and methods described in the prior art are aimed predominantly to hold the handles down to the side away from the mouth of pre-existing, cylindrical paint containers. The containers themselves are fabricated separately and do not form part of the inventive concept. In addition, these commercially bought containers with paint are heavy to hold in one hand even if provided the additional support for the thumb to hold the handles down as described in these prior art.

Professional painters are generally in the practice of, and in fact prefer, transferring a small quantity of the paint, usually a quart or so from the original commercial paint containers to another hand-held bucket to allow for greater balance when walking or climbing stairs, less spillage of the paint, and to reduce fatigue to the arm and hand holding the paint bucket. A quart of paint is sufficient to brush for a period of time before the need to replenish the paint in the bucket arises. A cone-shaped, wide-mouthed bucket is preferable to professional painters for easy access with a brush. In addition, to sufficiently load the paint brush with the paint, it is necessary for the bucket to be deep enough to comfortably slap the bristles of the brush on the interior sides of the bucket. This process loads the brush and controls the degree of dripping.

The natural proclivity for a painter is to lift and hold a paint bucket from the bottom end. Although both spillage and dripping are important to a professional and novice painter alike, the primary focus should be in the development of a paint bucket that can be lifted and held from the bottom for a prolonged period of time so that the user can work more comfortably and expend less energy to complete the task of painting a certain surface or object. U.S. Pat. No. 7,644,835 to Bergman describes a hand-held vessel with a strap on one side adaptable to accept a user's hand and secure it to the outer surface of the vessel wall. The vessel described in this prior art requires the user to insert their hand through the strap and hold the vessel using its sides for support which can lead to strain and fatigue to the hand if held for a period of time.

The present invention overcomes the deficiencies described in the prior art by providing a paint bucket which can be held in the palm of one hand without the use of a handle, hooks, straps, or other appendages.

SUMMARY OF THE INVENTION

The present invention is a bucket for holding and transporting paint or other material without the means of handles or other appendages. The paint bucket of the present invention is configured to be held securely in the palm of one hand through its bottom end without the danger of tilting or spillage of paint or other liquid from the container, as it is transported.

It is an object of the present invention to provide a paint bucket that fulfills the natural proclivity of a painter to hold the bucket from the bottom, using one hand.

It is another object of the present invention to provide a paint bucket that is lightweight and easily portable using only one hand.

With these objects in mind, an exemplary embodiment of the paint bucket of the present invention has a conical shaped body with a wide top, a narrower base and a circular foot section at the bottom end. This foot section has a fairly large and predominant aperture at its' middle center through which all four fingers of a hand with the palm facing upward can be inserted to lift and hold the bucket up vertically. In this embodiment of the paint bucket, once the fingers of the hands are inserted though the aperture at the foot of the bucket, the thumb is positioned on the outside of the aperture to wrap around the foot section of the bucket to provide additional support to the fingers in order to hold the bucket up vertically. In this embodiment of the invention, the bucket does not need to be first lifted from a surface before inserting the fingers of the hand through the aperture in the foot section of the paint bucket.

In the exemplary embodiment of the paint bucket of the present invention, once the fingers of the hand are inserted into the aperture at the foot section of the bucket, control of the side-to-side movement of the bucket is maintained by squeezing the thumb towards the index finger. The weight of the bucket and its contents is thus centered and held by one hand.

In all embodiments of the paint bucket of the present invention, once the painting task is completed, the bucket can be set down on a surface and the fingers along with the entire hand can be slid out of the aperture in the foot section, effortlessly.

In the exemplary embodiment of the paint bucket of the present invention, the bucket is conical shaped with a wide top and a narrower bottom. It is to be understood that other shapes are also envisioned and fall within the spirit and scope of the present invention of the paint bucket.

In a related embodiment of the paint bucket of the present invention, the bucket is constructed seamlessly from one piece of material such as extruded plastic or other similar material and can be made in three or more sizes to fulfill the requirements of the painter or the painting job.

In most embodiments of the paint bucket of the present invention, a detached lid is provided to secure and keep the mouth of the bucket closed when the bucket with the paint is not in use.

In this summary of the invention, and in the specification in general, the various references to, "an exemplary embodiment," "related embodiment," and "most embodiments" do not necessarily refer to the same embodiment (s). Rather, these references to the various embodiments in general mean that a particular feature, structure, or characteristic described in conjunction with an embodiment is included in at least some embodiments, but not necessarily all embodiments of the invention. Although the present invention has thus been described with reference to its exemplary and related embodiments, these embodiments should not be construed as limitations on the scope of the invention. It is to be understood by those skilled in the art, that the invention can be implemented in embodiments other than the ones described in this summary of the invention. For instance, the bucket of the present invention can also be used to store and transport other materials besides paint.

The features and embodiments of the present invention as described in this summary of the invention will be further appreciated and will become obvious to one skilled in the art when viewed in conjunction with the accompanying drawings, detailed description of the invention, and the appended claims.

DETAILED DESCRIPTION OF THE INVENTION

The present invention is a paint bucket with a unique bottom hold feature that allows for lifting and holding the bucket with one hand without the use of a handle, holders, hooks, or straps.

Figure 1:
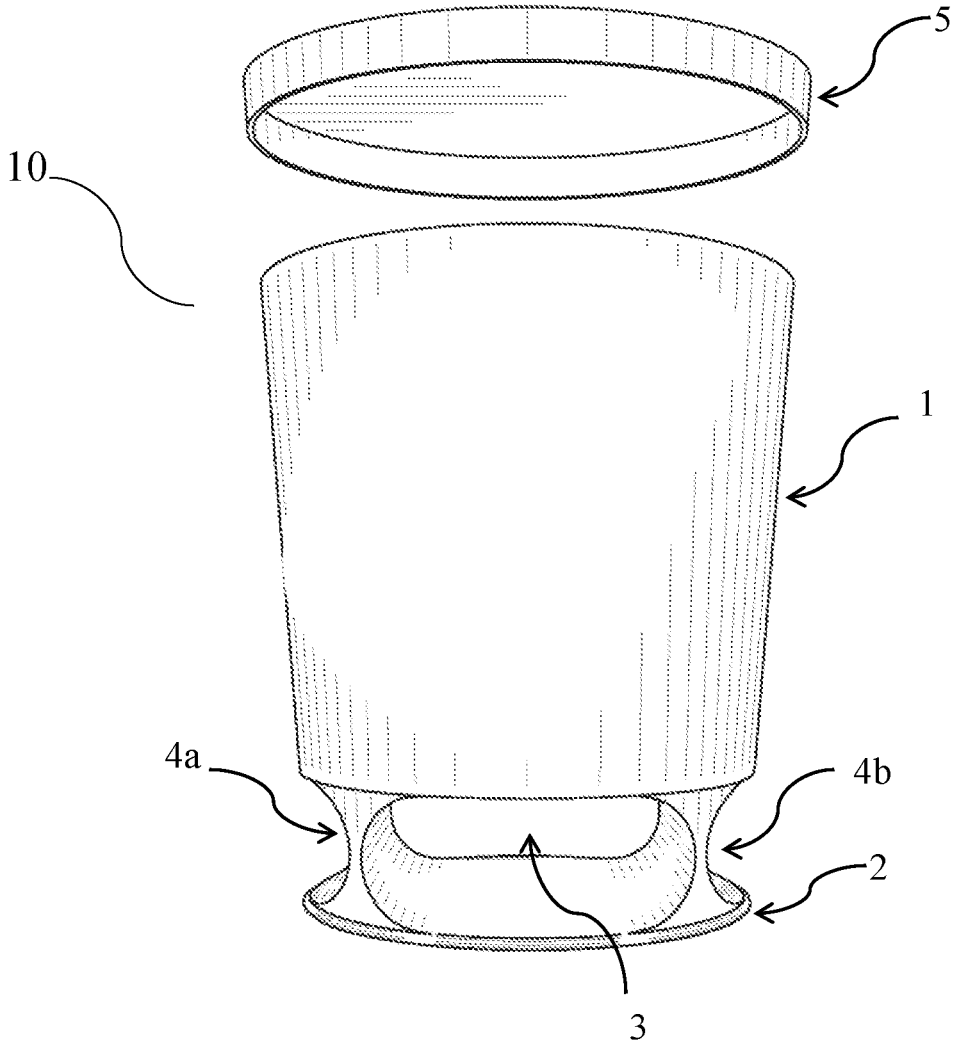
FIG. 1 is a perspective view of an exemplary embodiment of the paint bucket of the present invention.

Referring now to the drawings, in particular to FIG. 1 a perspective view of an exemplary embodiment of the paint bucket 10 of the present invention is shown with its conical-shaped body 1 with a wide top and a narrower base. This exemplary embodiment of the paint bucket of the present invention is configured with a circular foot section 2 attached to the narrow base of the paint bucket. The foot section 2 has a rounded rectangular shaped aperture 3 at its middle center with a pair of inwardly curved recesses 4*a* and 4*b* on either side of the aperture 3 contributing to the unique design of the foot section 2 of the paint bucket. The bottom of the foot section 2 is circular and flat so that it can be placed on a flat surface when the bucket is not in use. In this embodiment of the paint bucket 10 the index, middle, ring and pinky fingers of an open hand with the palm facing upward can be slid into the aperture 3 at the foot section 2 of the paint bucket 10 with the tips of the fingers coming out through the other end of the aperture 3 in the foot section 2. In this embodiment, once the fingers are inserted through the aperture 3 in the foot section of the paint bucket, the thumb would remain outside hugging one of the curved recesses 4*a* or 4*b* depending on from which side of the foot section 2 of the paint bucket the fingers of an open hand are inserted and also which hand, right or left is inserted through the aperture 3 in the foot section 2 of the bucket. In this embodiment of the paint bucket 10 once all the fingers are inserted into the aperture 3 in the foot section of the paint bucket, the paint bucket 10 can be lifted up and held by one hand with the weight centered on and held by the hand. In this exemplary embodiment of the paint bucket 10 control of the side-to-side movement of the bucket is maintained by squeezing the thumb towards the index finger. In this embodiment of the paint bucket 10 once the task of painting is completed, the bucket can be set down on a surface and the fingers of the hand slid out from the aperture 3 in the center of the foot section 2. In this figure, a detached lid 5 is shown for the purpose of illustrating that a lid can be used to cover the mouth of the paint bucket 10 when needed and to secure and keep the paint from being exposed to the outside air when it is stored. The paint bucket 10 can be configured and manufactured in different shapes and sizes to fit the needs of the user.

Figure 2:
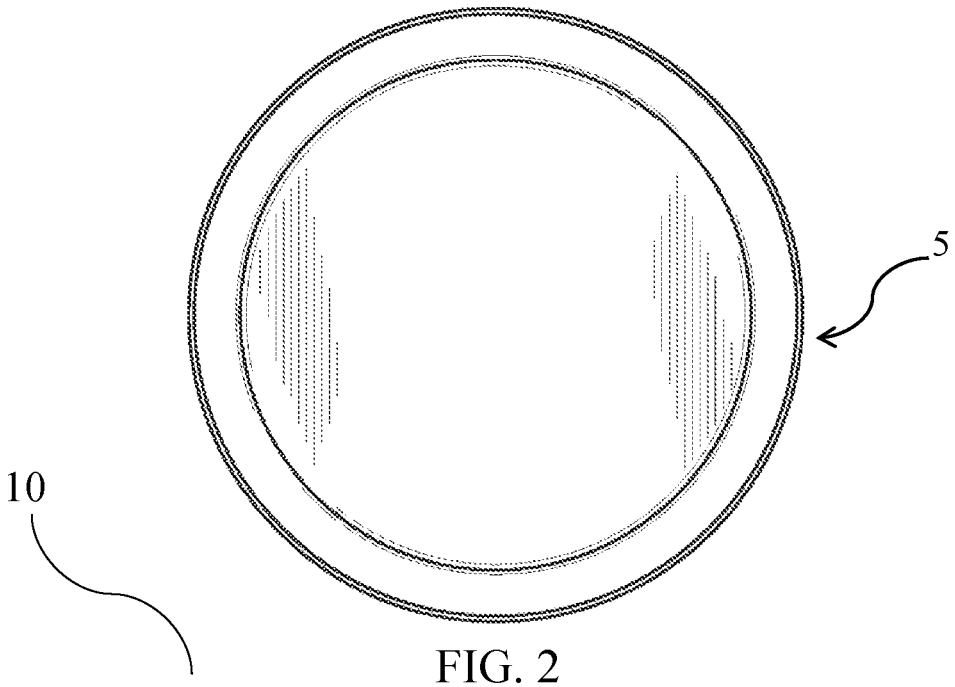
FIG. 2 is a top view of the paint bucket of the present invention.

FIG. 2 is a top view of the paint bucket 10 of the present invention.

Figure 3:
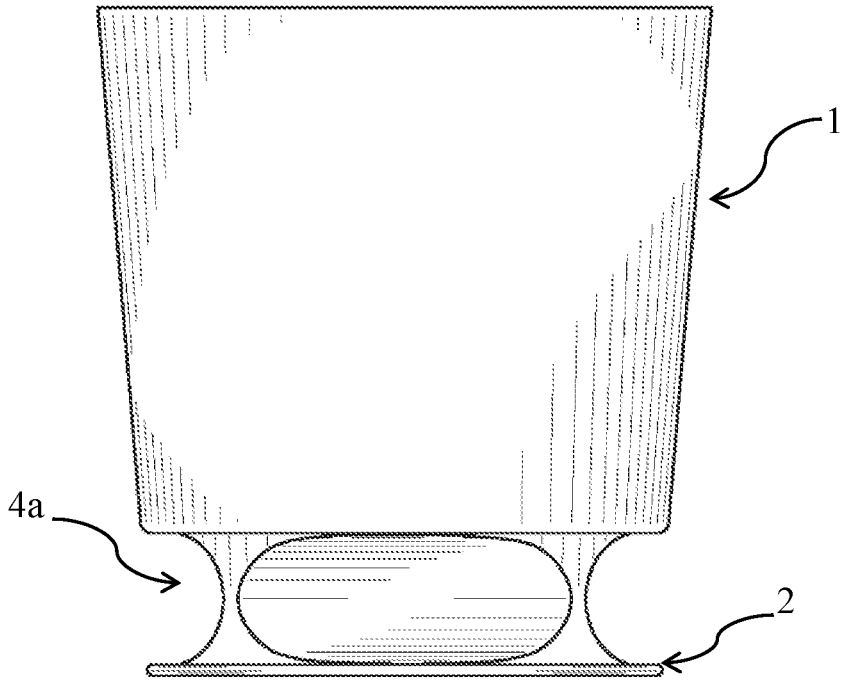
FIG. 3 is a side view of the paint bucket of the present invention.

FIG. 3 is a side view of one embodiment of the paint bucket 10 of the present invention with its conical shaped body 1 the foot section 2 and the curved recess 4*a* in the foot section 2.

Figure 4:
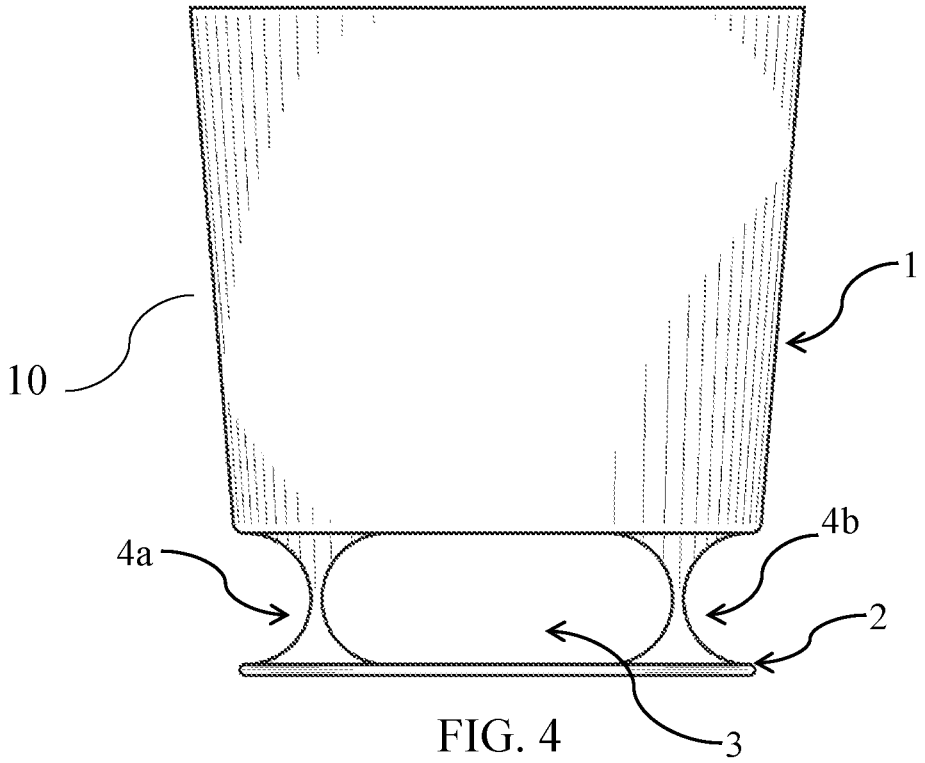
FIG. 4 is a front view of the paint bucket of the present invention.

FIG. 4 shows a front view of the paint bucket 10 with its conical shaped body 1 the foot section 2 the aperture 3 in the foot section 2 and the curved recesses 4*a* and 4*b*.

Figure 5:
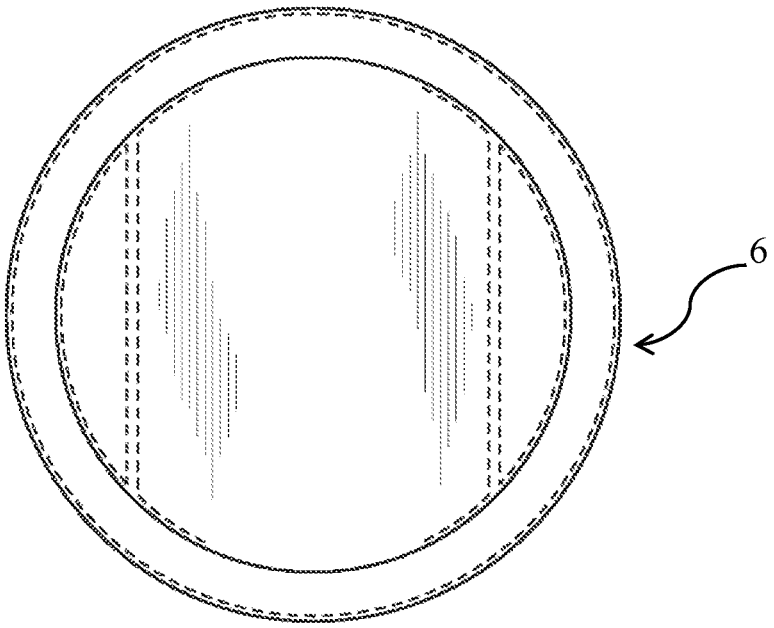
FIG. 5 is a view of the circular bottom of the foot section of the paint bucket of the present invention.

FIG. 5 is a view of the circular bottom 6 of the foot section 2 of the paint bucket 10 of the present invention.

Figure 6:
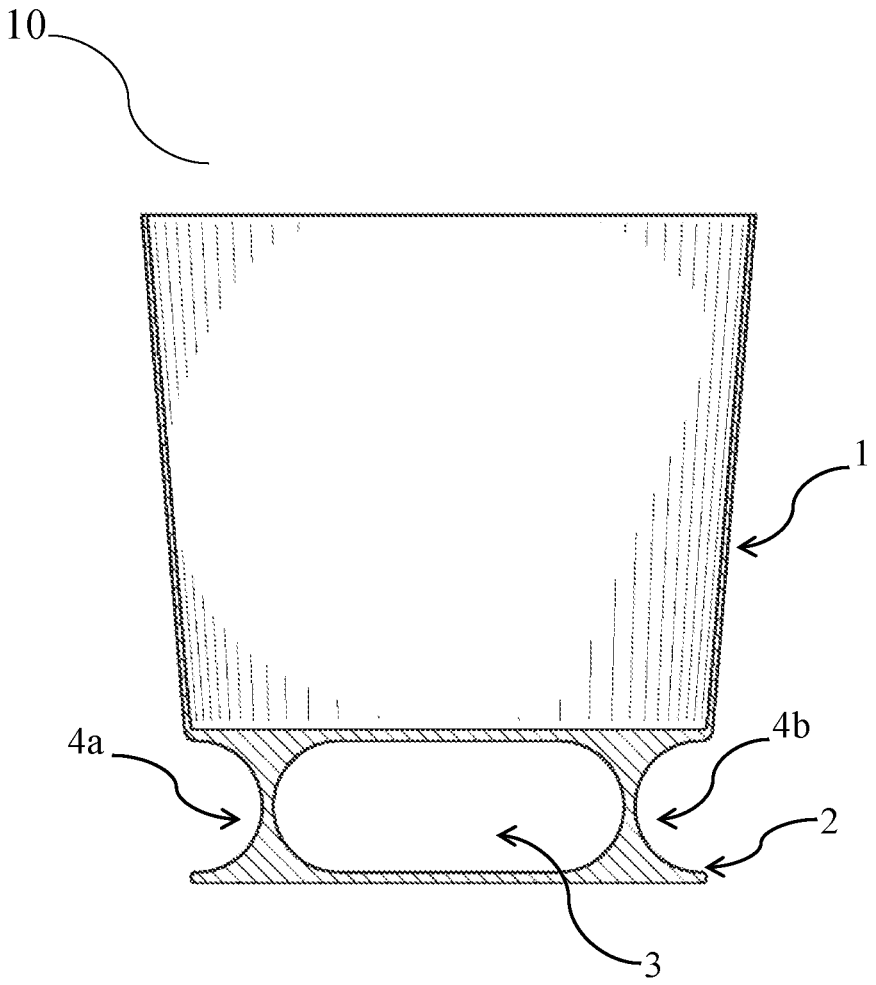
FIG. 6 is a cross sectional view of the paint bucket of the present invention.

FIG. 6 is a cross sectional view of the paint bucket 10 of the present invention with its conical shaped body 1 the foot section 2 the aperture 3 in the foot section 2 and the curved recesses 4*a* and 4*b*.

Figure 7:
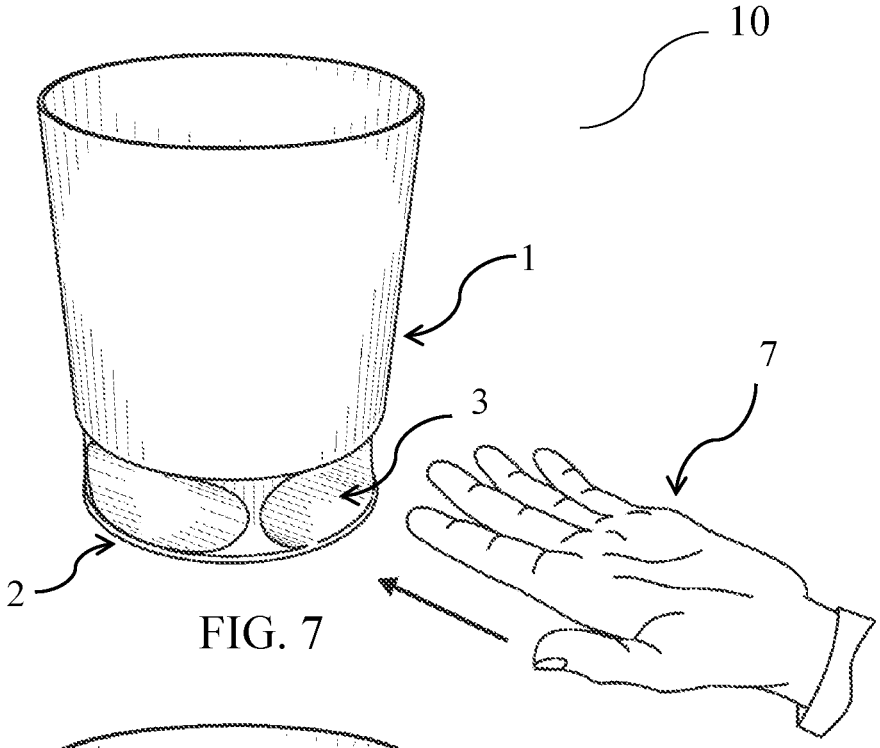
FIG. 7 is a perspective view of the manner in which the hand with its palm facing upward is extended towards the paint bucket so that the fingers can be inserted into the aperture in the foot section of the paint bucket of the invention.

FIG. 7 is a perspective view of the manner in which the hand 7 with its palm facing upward is extended towards the paint bucket 10 of the present invention so that the four fingers can be inserted into the aperture 3 in the foot section 2 of the paint bucket 10 of the invention to lift the bucket up vertically with one hand.

Figure 8:
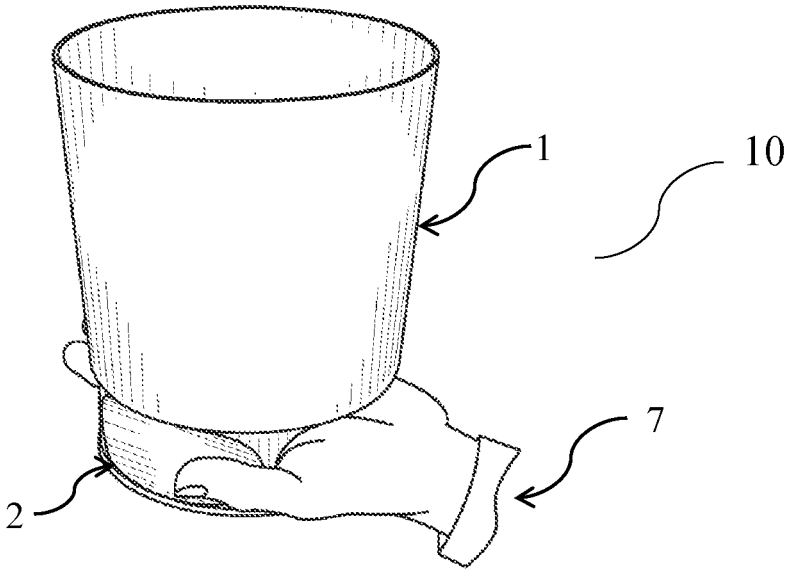
FIG. 8 is a perspective view illustrating how the fingers of the hand are inserted into the aperture at the foot section of the paint bucket with the thumb projecting outside to wrap around the foot section of the paint bucket of the invention.

FIG. 8 is a perspective view that shows the insertion of the fingers of the hand 7 into the foot section 2 of the paint bucket 10 through the aperture 3 (covered by the fingers) with the tips of the fingers visible at the other end of the aperture. In the exemplary embodiment of the paint bucket 10 once the fingers of the hand 7 are inserted into the aperture in the foot section of the paint bucket 10 the thumb wraps around the foot section of the paint bucket 10 to provide further reinforcement so that the bucket can be lifted from any surface and held vertically up through its bottom end with one hand, without much effort. In this embodiment, control of the side to side motion of the paint bucket 10 when thus held up can be effectuated by squeezing the thumb towards the index finger ensconced within the aperture in the foot section 2. In this view, the left hand is shown inserted into the foot section of the paint bucket 10. When the right hand is used to lift the paint bucket 10 the fingers of the open faced hand 7 can be inserted through the aperture in the foot section 2 from the opposite end of the paint bucket 10 of the invention.

The foregoing description of the invention through its figures and preferred embodiment should not be construed to limit the scope of the invention. It is to be understood that the embodiment of the present invention as described herein do not limit any application or scope of the invention and that the invention can be carried out and practiced in various ways and implemented in embodiments other than the ones outlined in the description above. It is to be further understood that the phraseology and terminology used to describe the invention are for descriptive purposes only. It should be understood and obvious to one skilled in the art that alternatives, modifications, and variations of the embodiments of the present invention may be construed as being within the spirit and scope of the appended claims.

What is claimed is:

1. A container comprising:

a body structure member with a conical shaped body having an open end and a closed base end;

a circular foot section attached to the closed base end of the conical shaped body and comprising:

an aperture extending through said circular foot section from a front side to a back side and substantially centrally located;

a pair of inwardly curved recessed members configured on opposing sides of said aperture and extending substantially parallel with the aperture from the front side to the back side, and extending under the closed base end of the body structure member; and a flat bottom portion;

wherein the circular foot section is configured for insertion of a person's hand, comprising a plurality of fingers and a palm, therein, wherein said aperture is configured for the insertion of the plurality of fingers and the palm therein, wherein the person's palm is configured under the closed base end of the conical shaped body;

wherein said aperture is configured for insertion of a persons hand into either side of the said aperture; and wherein said pair of curved recessed members are configured to receive a person's thumb of the person's hand such that the thumb is also configured under the closed base end of the conical shaped body and substantially in line with the plurality of fingers and the palm.

2. The container as in claim 1, wherein the container is a paint bucket.

3. The container as in claim 1 wherein the container is a single piece.

4. The container of claim 3, wherein the container consists essentially of plastic.

5. The container of claim 1, wherein the conical shaped body is wider at the open end than at the closed base end.

6. The container of claim 1, wherein the aperture extends from the closed base end of the conical shaped body to the flat bottom portion of the circular foot section.

7. The container of claim 6, wherein the aperture is substantially oval in shape.

8. The container of claim 6, wherein the aperture has a pair sides that are curved.

9. The container of claim 8, wherein the pair of curved recesses extend parallel with the aperture and have a curved shape that is substantially the same as the pair of sides.

10. The container of claim 1, wherein the pair of curved recesses extend substantially parallel with the aperture.

* * * * *